United States Patent [19]

Remley

[11] Patent Number: 4,684,605

[45] Date of Patent: Aug. 4, 1987

[54] ELEMENTS HAVING HYDROPHILIC LAYERS CONTAINING HYDROPHOBES IN POLYMER PARTICLES

[75] Inventor: Herbert D. Remley, Rochester, N.Y.

[73] Assignee: Eastman Kodak Company, Rochester, N.Y.

[21] Appl. No.: 824,392

[22] Filed: Feb. 3, 1986

Related U.S. Application Data

[60] Division of Ser. No. 746,946, Jun. 21, 1985, Pat. No. 4,584,255, which is a continuation of Ser. No. 562,136, Dec. 16, 1983, abandoned.

[51] Int. Cl.[4] ..... G03C 1/76

[52] U.S. Cl. ..... 430/537; 430/502; 430/531; 430/539

[58] Field of Search ..... 430/502, 537, 539, 139, 430/531

[56] References Cited

U.S. PATENT DOCUMENTS

| | | | |
|---|---|---|---|
| 3,369,901 | 2/1968 | Fogg et al. | 430/538 |
| 3,418,127 | 12/1968 | Millikan . | |
| 3,582,339 | 6/1971 | Martens et al. | 430/538 |
| 3,666,680 | 5/1972 | Briggs . | |
| 4,077,804 | 3/1978 | Vanzo . | |
| 4,106,941 | 8/1978 | Scullard et al. . | |
| 4,203,716 | 5/1980 | Chen . | |
| 4,206,072 | 6/1980 | Meyer et al. . | |
| 4,358,533 | 11/1982 | Tokitou et al. | 430/537 |

FOREIGN PATENT DOCUMENTS

| | | |
|---|---|---|
| 2509342 | 9/1975 | Fed. Rep. of Germany . |
| J52-038551 | 9/1975 | Japan . |
| 1421529 | 9/1971 | United Kingdom . |

*Primary Examiner*—Jack P. Brammer

*Attorney, Agent, or Firm*—Paul L. Marshall

[57] ABSTRACT

Disclosed herein are elements, including radiation-sensitive elements (e.g. color photographic paper products) which have, on a support, a substantially crystal- and agglomeration-free hydrophilic layer. This layer comprises a hydrophilic composition comprising a hydrophilic binder and water-insoluble polymer particles dispersed therein. These particles have recurring units derived from one or more ethylenically unsaturated polymerizable monomers, and comprise from about 0.5 to about 10 percent, based on total monomer weight, of a hydrophobe uniformly distributed throughout. Particularly useful polymer particles are those having recurring units derived from at least one monomer having a crosslinkable moiety. Particularly useful hydrophobes are optical brighteners. A method of making these elements is also disclosed herein.

6 Claims, 10 Drawing Figures

ELEMENTS HAVING HYDROPHILIC LAYERS CONTAINING HYDROPHOBES IN POLYMER PARTICLES

This is a division of application Ser. No. 746,946, filed June 21, 1985 now U.S. Pat. No. 4,584,255, which is a continuation of application Ser. No. 562,136 filed Dec. 16, 1983 now abandoned.

FIELD OF THE INVENTION

This invention relates to elements, including radiation-sensitive elements (e.g. color photographic elements). In particular, it relates to such elements having a hydrophilic layer which contains a hydrophobic compound (e.g. optical brightener) uniformly distributed in polymeric particles. This invention also relates to a method of making such elements.

BACKGROUND OF THE INVENTION

Several techniques have been used heretofore to distribute hydrophobic compounds (hereinafter, "hydrophobe"), particularly non-polymeric compounds such as color-forming couplers, ultraviolet light absorbing materials, optical brighteners, etc., uniformly throughout layers of gelatin or other hydrophilic binder materials in the manufacture of radiation-sensitive products. One of the simplest of these techniques involves mechanically dispersing the hydrophobe in solid or liquid form in the binder material by passing a blend of the hydrophobe and material several times through a high energy mill. This technique, however, generally produces unsuitable dispersions which are often unstable.

Another technique is described in U.S. Pat. No. 4,203,716 (issued May 20, 1980 to Chen). That technique involves "loading" polymeric latex particles with the hydrophobe using an organic solvent. Generally, "loading" involves (1) dissolving the hydrophobe in a suitable water-miscible organic solvent; (2) mixing the resulting solution with polymeric latex particles; and (3) removing residual solvent as desired, particularly if necessary to drive the "loading" process to completion, or to provide material sufficiently "loaded" with the hydrophobe. The "loaded" latex is then usually dispersed in a hydrophilic binder in preparation for coating.

Depending upon the hydrophobe, sometimes only a limited amount of hydrophobe can be successfully "loaded" into latex particles, and any residual hydrophobe must be removed to prevent deleterious image effects. Often some of the hydrophobe "leaches" out of the latex particles and forms "crystals." Such crystals deleteriously affect image quality (e.g. reduce sharpness) and, when clumped together, reduce layer smoothness which is important for very thin coatings. This leached-out hydrophobe can also wander into adjacent layers, causing additional problems.

U.S. Pat. No. 3,418,127 (issued Dec. 24, 1968 to Millikan) discloses a method of finely dispersing a fluorescent compound in latex particles by mixing the fluors in polymerizable monomers and emulsion polymerizing the monomers having the fluors therein. The resulting latex purportedly can be coated and dried to form a thin film, preferably over the radiation-sensitive layers of a photographic element. Similarly, W. German Patent No. 2,509,342 (published Sept. 11, 1975) teaches the incorporation of optical brighteners into polymeric particles by dissolving the optical brighteners in polymerizable monomers and emulsion polymerizing the monomers. Emulsion polymerization proceeds in micelles formed by water-soluble surfactant. Additional monomer and hydrophobe migrate from monomer droplets through the water phase and into the micelles prior to polymerization. The resulting latex is purportedly mixed with a compatible colloid (e.g. gelatin) and coated either with a photographic emulsion or in a separate layer in a photographic element.

However, attempts to prepare substantially crystal- and agglomeration-free hydrophilic coating compositions according to the teaching of W. German Patent No. 2,509,342 have been unsuccessful. In particular, as illustrated in Example 1 hereinbelow, the polymer particles of a latex having an optical brightener dissolved therein tended to agglomerate during polymerization. This tendency to agglomerate appeared to increase with time and the resulting polymeric mass could not be coated to form a thin film.

Hence, there is a need in the art for a way to provide relatively inexpensive and simply-made hydrophilic compositions containing hydrophobes which can be coated to provide substantially crystal- and agglomeration-free hydrophilic layers on a substrate.

SUMMARY OF THE INVENTION

The present invention overcomes the problems described above. It provides elements, including radiation-sensitive elements, which comprise polymer particles having a hydrophobe, e.g. an optical brightener, uniformly distributed throughout. These particles are distributed in a hydrophilic layer which is substantially crystal-free, meaning that substantially all (preferably at least 99 percent) of the hydrophobe is distributed within particles of polymer. The hydrophilic layer is substantially agglomeration-free, meaning very few, if any, of the polymer particles have agglomerated. Rather, the particles are distributed throughout the hydrophilic layer. It has also been found that hydrophobes are less likely to wander in the elements of this invention.

It is believed that the advantages of this invention are obtained because the monomers containing the hydrophobe are dispersed in the aqueous medium and allowed to polymerize as a suspension of fine monomer droplets. This technique avoids the problems encountered with emulsion polymerization of hydrophobe-containing monomers wherein the monomer containing hydrophobe must migrate through water and cross the interface of latex micelles. During such migration, the monomer tends to migrate faster than the hydrophobe. Therefore, the concentration of the hydrophobe in the monomer droplets outside the micelles increases to a point where the hydrophobe concentration reaches a saturation point in those droplets, and hydrophobe crystallization then occurs.

Therefore, in accordance with this invention, an element comprises a support having thereon a substantially crystal- and agglomeration-free hydrophilic layer. This layer comprises a hydrophilic composition comprising a hydrophilic binder and water-insoluble polymer particles dispersed therein. These particles have recurring units derived from one or more ethylenically unsaturated polymerizable monomers and comprise from about 0.5 to about 10 percent, based on total monomer weight, of a hydrophobe uniformly distributed throughout.

In a preferred embodiment, the elements of this invention are radiation-sensitive elements (e.g. color photographic paper products) which have the hydrophilic layer described above located between the support and the radiation-sensitive layer(s). The hydrophobe in this embodiment is an optical brightener.

This invention also comprises a method of making the element described hereinabove. The steps of this method comprise:

(a) dissolving from about 0.5 to about 10 percent, based on total monomer weight, of a hydrophobe in solution with one or more ethylenically unsaturated polymerizable monomers;

(b) dispersing the solution formed in (a) as fine droplets in water under conditions sufficient to promote polymerization of the monomers in the suspended droplets and to form polymeric particles having the hydrophobe uniformly distributed throughout the particles;

(c) dispersing the polymeric particles in a hydrophilic binder to form a hydrophilic composition; and (d) applying the hydrophilic composition to a support to form a substantially crystal- and agglomeration-free hydrophilic layer.

In a preferred embodiment of this invention, a radiation-sensitive composition is applied over the hydrophilic layer formed in step (d).

DETAILED DESCRIPTION OF THE INVENTION

Figure 1:
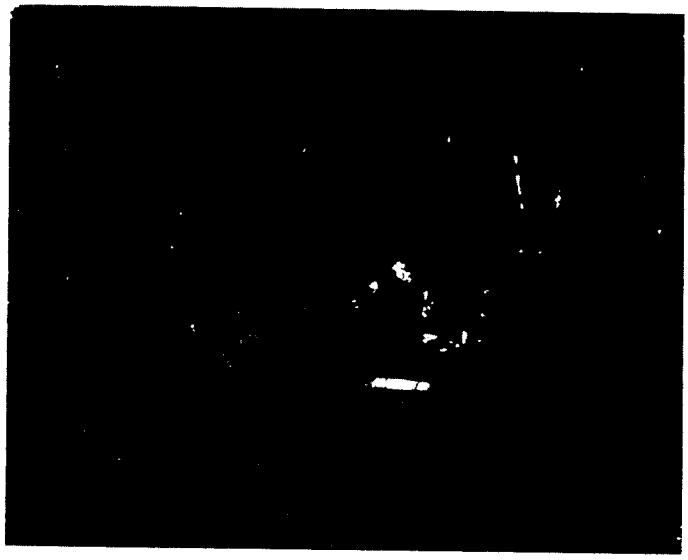
FIGS. 1–4 are photomicrographs taken at 250× magnification of "loaded" latex emulsions and hydrophilic coating compositions comprising same prepared according to the teaching of U.S. Pat. No. 4,203,716, noted hereinabove.

The hydrophobe useful in the practice of this invention is a compound which is essentially insoluble in distilled water at 25° C. Preferably, the dissolved concentration of hydrophobe in water under these conditions is less than about 0.5 weight percent, based on the weight of the water. Any such hydrophobe can be used in the practice of this invention as long as it can be dissolved or uniformly dispersed in the ethylenically unsaturated polymerizable monomer(s) to be used in making the polymer particles described hereinbelow. Preferably, the hydrophobe is soluble in the monomers at a concentration of at least 8 weight percent, based on the total monomer weight.

Examples of useful functional classes of hydrophobes include, but are not limited to, photographic dyes; photographic dye-forming couplers; photographic developing agents or other photographic addenda; optical brighteners; ultraviolet light absorbing compounds; and others known to one skilled in the photographic art. Specific photographic addenda which can act as hydrophobes include those compounds used to perform coupling, silver halide development, oxidized developer scavenging, absorb light of certain wavelengths, spectral sensitizing or desensitizing, or diffusion transfer dye image-forming. Examples of such hydrophobes are listed in considerable detail in U.S. Pat. No. 4,203,716 (noted hereinabove), the disclosure of which is incorporated herein by reference in its entirety; and in *Research Disclosure,* publications 15162 (November, 1976) and 17643 (December, 1978), paragraphs III, IV, VI, VII and VIII (*Research Disclosure* is published by Kenneth Mason Publications Limited, Emsworth, Hampshire, P010 7DD, United Kingdom). Mixtures of hydrophobes can be used if desired.

Hydrophobes of particular usefulness in the practice of this invention are optical brighteners. In general, useful optical brighteners include such classes of compounds as: oxazoles; oxadiazoles, including benzoxazoles; imidazoles, including benzimidazoles; pyrazolines; coumarins; stilbenes; triazines; imidazolones; naphthotriazoles; acetylenes; vinylene compounds; and others known to a skilled worker in the art. Specific examples of such optical brighteners are described in *Research Disclosure,* publication 17643, paragraph V, noted hereinabove, U.S. Pat. No. 3,666,680 (issued May 30, 1972 to Briggs) and W. German OLS No. 2,509,342, noted hereinabove, the disclosures of which are incorporated herein by reference to illustrate optical brighteners useful in this invention.

Of the many classes of optical brighteners which can be used in the practice of this invention, the stilbene and naphthotriazole compounds are preferred, with such brighteners as Uvitex OB TM, Tinopal PCR TM and Tinopal SFG TM being particularly useful. These optical brighteners are commercially available from Ciba-Geigy, Ardsley, N.Y.

The amount of hydrophobe in the polymer particles can be varied widely depending upon intended use, but generally it is from about 0.5 to about 10 weight percent, based on total weight of the monomers in which it is dissolved. Preferably, the amount is from about 1 to about 8, and more preferably between about 2 and about 5, weight percent, based on the total monomer weight.

The polymer particles useful in the practice of this invention are composed of water-insoluble homopolymers or copolymers having recurring units derived from one or more ethylenically unsaturated polymerizable monomers. These copolymers can have recurring units derived from two or more of such monomers, preferably one of which is a monomer having crosslinkable moieties in the molecule. Such monomers are described in more detail hereinbelow.

Preferably, the water-insoluble polymeric particles useful in this invention comprise polymers characterized by the structure:

$$-(A)_x(B)_z(C)_y$$

wherein -A- represents randomly recurring units in the polymer chain derived from one or more vinyl aromatics; vinyl esters; olefins and diolefins; or esters of $\alpha,\beta$-unsaturated polymerizable carboxylic acids. Examples of useful vinyl aromatics include styrene, $\alpha$-methylstyrene, p-bromostyrene, o-chlorostyrene, 2-vinylmesitylene, 1-vinylnaphthalene, m- and p-vinyltoluene, 3,4-dichlorostyrene and the like. Useful vinyl esters include, for example, vinyl acetate, vinyl propionate, vinyl butyrate and the like. Examples of useful esters of $\alpha,\beta$-unsaturated polymerizable carboxylic acids include methyl acrylate, methyl methacrylate, n-butyl acrylate, n-butyl methacrylate, t-butyl methacrylate, benzyl methacrylate, methyl $\alpha$-bromoacrylate, 4-chlorobutyl acrylate, cyclohexyl acrylate, 2-norbornylmethyl acrylate, 2-ethylhexyl acrylate, lauryl methacrylate, tetrahydrofurfuryl methacrylate, 2-ethoxyethyl methacrylate, 3-chloropropyl acrylate, 2-2-dimethylbutyl acrylate, and the like. Useful olefins and diolefins include, for example, ethylene, propylene, 1,3-butadiene, isoprene, chloroprene, cyclopentadiene, 5-methyl-1,3,6-heptatriene, and the like.

Preferably -A- represents randomly recurring units derived from one or more vinyl aromatics, e.g. styrene, or esters of $\alpha$-$\beta$-unsaturated polymerizable carboxylic acids, e.g. methyl methacrylate, butyl acrylate and tetrahydrofurfuryl methacrylate. More preferably, -A- is derived from styrene or methyl methacrylate or both.

In the above-identified structure, -B- represents randomly recurring units in the polymer chain derived from one or more ethylenically unsaturated polymerizable monomers having one or more anionic moieties, e.g. sulfo, phosphono or carboxy moieties (including alkali metal or ammonium salts thereof). These recurring units contribute to the dispersibility of the polymer particles in hydrophilic binders. Examples of useful monomers having such anionic moieties include 4-acryloyloxybutane-1-sulfonic acid, sodium salt; 3-acryloyloxy-1-methylpropane-1-sulfonic acid, sodium salt; acrylic and methacrylic acids and alkali metal salts thereof; m- and p-styrenesulfonic acid and alkali metal salts thereof; 3-methacryloyloxy-propane-1-sulfonic acid, sodium salt; lithium methacrylate, N-[3-(N-phenylsulfonyl-N-sodiosulfamoyl)phenyl]acrylamide, N-[2-(N-methyl-sulfonyl-N-potassiosulfamoyl)ethyl]-methacrylamide, ammonium p-styrenesulfonate, 2-acrylamido-2-methylpropanesulfonic acid, sodium salt, and the like.

Preferably, -B- represents randomly recurring units derived from one or more monomers having sulfo or carboxy moieties, such as styrenesulfonic acids or alkali metal salts thereof, acrylic acid, methacrylic acid and 2-acrylamido-2-methylpropanesulfonic acid. More preferably, -B- is derived from styrenesulfonic acids or salts thereof.

Also, in the above-identified structure, -C- represents randomly recurring units in the polymer chain derived from one or more ethylenically unsaturated polymerizable monomers having crosslinkable moieties. Such units contribute to the water-insolubility of the resulting polymer. They also make the polymer less soluble in organic solvents generally used in coating operations and thereby reduce the tendency of the hydrophobe to wander.

These monomers can have two or more ethylenically unsaturated moieties which crosslink during polymerization (e.g. diacrylates, divinylbenzene, etc.). Alternatively, they can have moieties which do not react to provide crosslinking during polymerization, but provide crosslinking because of reaction with a hardener or with another moiety on a different monomer. Such monomers include, for example, 2-acetoacetoxyethyl methacrylate, N-(2-acetoacetoxyethyl)acrylamide, N-(2-acetoacetamidoethyl)acrylamide and 2-aminoethyl methacrylate hydrochloride. Monomers having two or more ethylenically unsaturated sites available for reaction include, for example, diacrylates; dimethacrylates; triacrylates; trimethacrylates; divinyl compounds; and the like. Examples of such monomers include divinylbenzene, ethylene dimethacrylate, 2,2-dimethyl-1,3-propylene diacrylate, propylidene dimethacrylate, 1,6-hexamethylene diacrylate, phenylethylene dimethacrylate, tetramethylene dimethacrylate, 2,2,2-trichloroethylidene dimethacrylate, ethylenebis(oxyethylene) diacrylate, oxydiethylene diacrylate, ethylidyne trimethacrylate, allyl acrylate, vinyl allyloxyacetate, 1-vinyloxy-2-allyloxyethane, 2-crotonoyloxyethyl methacrylate, diallyl phthalate, triallyl cyanurate, 2-(5-phenyl-2,4-pentadienoyloxy)ethyl methacrylate, N,N'-methylenebisacrylamide, N,N'-bis(methacryloyl)urea, and the like.

Preferably, -C- represents randomly recurring units derived from one or more diacrylates or dimethacrylates, e.g. ethylene diacrylate or ethylene dimethacrylate or both.

The polymers useful in the practice of this invention can also comprise minor amounts (less than about 5 weight percent) of randomly recurring units in the polymer chain derived from one or more ethylenically unsaturated polymerizable monomers other than those described for -A-, -B- or -C- hereinabove. Generally, these units are present in very small amounts in the polymer chain so as not to deleteriously affect polymer water insolubility or other desirable polymer properties. For example, they can be derived from vinyl amides (e.g. acrylamide, methacrylamide, N-isopropylmethacrylamide, N-isopropylacrylamide, N-(3,6-dithiaheptyl)-acrylamide, etc.); vinyl nitriles (e.g. acrylonitrile, methacrylonitrile, 3-butenenitrile, etc.); vinyl ketones (e.g. methyl vinyl ketone, diacetone acrylamide, etc.); vinyl halides (e.g. vinyl chloride, vinyl bromide, vinylidene chloride, etc.); vinyl ethers (e.g. allyl methyl ether, allyl phenyl ether, 2-chlorovinyl methyl ether, etc.); N-vinylsuccinamide; N-vinylphthalimide; N-vinylpyrazolidinone; and others known to one skilled in the polymer chemistry art.

Generally, the proportions of the various units of the polymer structure defined herein are as follows: w represents a weight percent of from about 80 to 100, and preferably, from about 90 to about 99 weight percent; x represents a weight percent of from 0 to about 20, and preferably from about 0.5 to about 5 and more preferably from about 1 to about 3 weight percent; and y represents a weight percent of from 0 to about 5, preferably from about 0.5 to about 5, and more preferably from about 2 to about 4, weight percent. All weight percentages are based on total monomer weight.

In a preferred embodiment of this invention wherein the hydrophobes are optical brighteners, w is generally from about 90 to 100 weight percent, x is from 0 to about 5 weight percent and y is from 0 to about 5 weight percent.

Although the glass transition temperature (Tg) of the polymers useful in the practice of this invention can be varied widely, they generally have a glass transition temperature (Tg) greater than about 70° C., and preferably in the range of from about 90° to about 120° C., in order to prevent diffusion of hydrophobe into the coated layers during drying and storage and to improve compatibility with coating addenda. The glass transition temperature can be determined by any convenient method suitable for this purpose. For example, one such method is differential scanning calorimetry as described in *Techniques and Methods of Polymer Evaluation,* Volume 2, Marcel Dekker, Inc., N.Y., N.Y., 1970.

Examples of polymers useful in the practice of this invention include:

poly(methyl methacrylate);

poly(methyl methacrylate-co-styrene) (80:20 weight ratio);

poly(n-butyl acrylate-co-tetrahydrofurfuryl methacrylate-co-2-acrylamido-2-methylpropanesulfonic acid, sodium salt) (35:60:5 weight ratio);

poly(methyl methacrylate-co-methacrylic acid) (95:5 weight ratio);

poly(n-butyl methacrylate-co-methacrylic acid) (80:20 weight ratio);

poly(methyl methacrylate-co-ethylene dimethacrylate) (98:2 weight ratio);

poly(methyl methacrylate-co-styrene-co-ethylene dimethacrylate) (49:49:2 weight ratio);

poly(methyl methacrylate-co-styrene-co-styrene sodium sulfonate-co-ethylene dimethacrylate) (48.5:48.5:1:2 weight ratio);

poly(methyl methacrylate-co-styrene-co-divinylbenzene) (49:49:2 weight ratio); and poly(methyl methacrylate-co-styrene-co-sodium styrenesulfonate-co-divinylbenzene) (48.5:48.5:1:2 weight ratio).

The polymer particles useful in the practice of this invention are generally prepared by addition polymerization of the monomers in an aqueous suspension. This is commonly known as "suspension polymerization." It can be carried out in batch, semi-continuous or continuous operations, as is well known in the art.

Generally, the method of this invention includes dissolving the hydrophobe(s) in solution with the ethylenically unsaturated polymerizable monomers. The monomer solution is then dispersed as fine droplets in water and subjected to conditions sufficient to promote suspension polymerization of the monomers. Although, it is not always required, it is advantageous to use one or more polymerization initiators to initiate polymerization and promote its completion. At least one of the initiators, if used, is oleophilic and is dissolved in the monomers along with the hydrophobe. Useful oleophilic initiators include azo compounds, such as the VAZO TM initiators commercially available from DuPont, Wilmington, Del., e.g. VAZO-64 TM which is 2,2'-azobis(2-methylpropionitrile), VAZO-52 TM which is 2,2'-azobis(2,4-dimethylvaleronitrile), VAZO-33 TM which is 2,2'-azobis(2,4-dimethyl-4-methoxyvaleronitrile) and VAZO-67 TM which is 2,2'-azobis(2-methylbutanenitrile); peroxides, such as lauroyl peroxide and benzoyl peroxide; and others known to one skilled in the art. Water-soluble polymerization initiators can be used in addition to oleophilic initiators as long as there is sufficient oleophilic initiator to initiate the polymerization of the suspended monomer droplets and an insubstantial amount of emulsion polymerization occurs.

One or more surface active agents (i.e. surfactants) are also often employed in suspension polymerization to aid in keeping the dispersed monomer droplets from clumping together in the aqueous medium. At least one of the surfactants, if used, is oleophilic and is incorporated into the reaction mixture by dissolving it in the monomer(s) along with the hydrophobe.

It is often desirable to agitate the monomers in a suitable manner while the hydrophobe, initiator or surfactant is added and dissolved therein. Also, it may be advantageous to heat the monomers prior to and during such addition to facilitate dissolution. Normally, if this is done, the temperature of the monomers is maintained at greater than room temperature (20°–25° C.), but less than the temperature at which the monomers undergo spontaneous polymerization (this varies with the monomer(s) and initiators used). Generally, the temperature used for this purpose is in the range of from about 30° to about 45° C.

Once the hydrophobe is dissolved within the monomers, the resulting solution is dispersed in water as fine droplets and subjected to pressure and temperature conditions suitable for polymerization of the monomers in the suspended droplets and formation of small, suspended polymer particles. The monomer solution is generally present in droplet form in this dispersion in a range of from about 20 to about 50 percent, based on total dispersion weight. The pressure employed in the polymerization is generally only that needed to maintain the reaction mixture in liquid form, and is usually atmospheric pressure. The polymerization temperature is subject to wide variation as it depends upon several variables including the monomers, initiator and weight percent of monomers in the dispersion. However, generally the temperature is in the range of from about 20° C. to about 120° C., and preferably from about 50° to about 70° C. The temperature can vary during the polymerization reaction because of the evolution of heat from the reaction itself.

The monomer solution can be dispersed in the aqueous medium prior to polymerization in any suitable manner which may depend upon the polymerization technique (batch, continuous or semi-continuous) employed. Generally, the solution is dispersed in the aqueous phase by any means which produces high shear sufficient to form very fine droplets containing monomer, hydrophobe and preferably, oleophilic initiator and surfactant. For example, such dispersing can be accomplished by mechanical means such as high-speed stirring or vigorous agitation of some manner, or by pumping a monomer-water mixture through a small orifice or high shear mill into a reactor vessel.

Once polymerization has begun, it is continued until substantially all monomer has reacted. This may take up to 24 hours, depending upon the polymerization conditions employed.

Specific details of polymerization of the monomers having the hydrophobe dissolved therein are illustrated in the examples presented hereinbelow.

The resulting polymer is in the form of small particles, the size of which can be varied by changing the dispersing conditions or amount of surfactant. The average particle size is generally in the range of from about 0.1 to about 20 microns, with polymer particles in the range of from about 0.4 to about 1 microns being particularly useful in the preferred embodiment of this invention utilizing optical brighteners as the hydrophobe.

The resulting aqueous suspension of polymeric particles can be used directly after polymerization. Water may be removed, if desired, to increase the percent solids of the suspension.

The polymeric suspension is then uniformly dispersed in one or more hydrophilic binder materials, or "vehicles" as they are often called in the art, to form a hydrophilic composition. Such binders act as peptizers for the polymeric particles to reduce their tendency to settle. Suitable hydrophilic binders include both naturally-occurring substances, such as proteins (e.g. gelatin, gelatin derivatives, cellulose derivatives), polysaccharides (e.g. dextran), gum arabic, etc.; and synthetic polymeric substances such as water-soluble polymers (e.g. poly(vinyl alcohol), acrylamide polymers, poly(vinyl pyrrolidones), etc.), and others known to one skilled in the art, as described, for example, in *Reserch Disclosure,* publication 17643, noted hereinabove, paragraph IX. Gelatin is a preferred binder in the practice of this invention.

Generally, the polymeric particles are present within a binder in an amount of at least about 15, and preferably from about 20 to about 70, percent based on total dry weight of hydrophilic composition. This corresponds to a coating coverage of polymeric particles of at least about 20 mg/m$^2$ of coated surface area. Particles of different polymers containing the same or different hydrophobes can be used in the same hydrophilic composition, if desired.

Once the particles are blended in the binder, the resulting hydrophilic composition can be purified, if desired, in any suitable manner to remove any unwanted addenda.

The described hydrophilic composition can be applied to a suitable substrate, such as a conventional support, using conventional techniques to provide an element having a hydrophilic layer. Additional compositions can be applied simultaneously or subsequently to form additional layers over or under the hydrophilic layer. It is specifically contemplated to apply these compositions to a support using coating hoppers or other coating apparatus conventionally employed in preparing single or multiple layer radiation-sensitive elements. Useful coating and drying techniques and supports (e.g. paper, polymeric films, glass, etc.) are described, for example, in *Research Disclosure,* publication 17643, noted hereinabove, paragraphs XV and XVII.

The hydrophilic layer so formed is substantially crystal- and agglomeration-free. As used herein, "substantially crystal-free" and "substantially agglomeration-free" refer to a layer having substantially no crystals of hydrophobe or agglomerations of polymer particles within the layer. In other words, substantially all hydrophobe (preferably at least 99 percent) is in polymer particles rather than external to the particles, and very few polymer particles are stuck together. Generally, in the elements of this invention, less than 5 crystals of hydrophobe can be observed in a 3.5×4.5 in. (8.9×11.4 cm) area of the layer containing the hydrophobe as observed at 250× magnification. (See FIGS. 7 and 8 which are photomicrographs of a coated composition containing an optical brightener in an element of this invention).

The hydrophilic compositions described herein can be used in radiation-sensitive elements of various types. Generally, the coating coverage of the hydrophilic composition depends upon its use and the type of element it is incorporated into. Radiation-sensitive elements of this invention include, for example, image transfer materials, lithographic materials, physical development materials, radiographic materials, dry development materials, negative- and positive-working color-forming materials (including color films and color photographic papers), black-and-white films and papers, and the like. The details of such materials are well known in the art and are described, for example, in *Research Disclosure,* publication 17643, noted hereinabove.

In a preferred embodiment of this invention, the described hydrophilic compositions are useful in multilayer color photographic paper products having a resin-coated photographic paper support and a plurality of color-forming silver halide emulsion layers coated thereon.

The hydrophilic compositions can be used in any location in the radiation-sensitive elements of this invention, including within the radiation-sensitive layers themselves. Preferably, however, they are coated as individual hydrophilic layers, above, below or in between radiation-sensitive layers. In a preferred embodiment, the hydrophilic composition contains an optical brightener as the hydrophobe and is incorporated between the support and the radiation-sensitive layer(s) to provide an optical brightener layer.

The following examples are provided to illustrate the practice of this invention.

EXAMPLE 1

Part A

A photographic element of this invention containing an optical brightener hydrophilic layer was prepared in the following manner:

Methyl methacrylate (11.5 kg) monomer was added to a 40 L reactor vessel and warmed to 40° C. with gentle stirring. Uvitex OB TM (386 g), an optical brightener commercially-available from Ciba-Geigy (located in Ardsley, N.Y.), was added to the stirring monomer until it was completely dissolved. Then, Aerosol OT-100 TM (230 g), an oleophilic surfactant commercially available from American Cyanamid (located in Wayne, N.J.), and 2,2'-azobis(2-methylpropionitrile) polymerization initiator (57.5 g) were similarly added to and dissolved in the monomer. Once all of the reagents were dissolved, stirring in the vessel was increased to about 200 rpm and distilled water (26.8 kg) heated to 50° C. was added to the monomer solution.

The resulting dispersion was stirred for an additional 10 minutes and then pumped through a commercially-available high shear Manton-Gaulin mill at 2850 rpm using an orifice clearance of 0.004 in (0.01 cm) and a flow rate of 1.5 L/min. into another 40 L reactor vessel where stirring was set at 40 rpm and the temperature controlled at 65° C. The time for pumping through the mill was about 26 minutes. This high shear dispersing means provided very fine droplets of monomer in the aqueous phase. Polymerization began immediately and was allowed to proceed for about 2 hours at 65° C. to give a suspension of polymeric particles of about 25% solids.

With the temperature maintained at 65° C., gelatin (1.56 kg) was added to the polymer suspension with agitation. The resulting hydrophilic composition was kept at 65° C. and stirred at 40 rpm for about 1 hour, filtered through a 30μ filter at 65° C. and chill set at 40° C. The yield of hydrophilic composition was about 39 kg.

The hydrophilic composition so prepared was coated on a polyethylene support to provide an element of this invention having substantially no crystals or agglomerations.

Part B

Several attempts were made to prepare an element according to the teaching of W. German OLS No. 2,509,342 noted hereinabove. The procedure and materials of that teaching were used with the following minor exceptions:

1. Tinopal PCR TM (available from Ciba-Geigy Co.) was used as the optical brightener in place of the equivalent, similarly structured Optical brightener B; Tinopal PCR TM is a stilbenetriazole having the structure:

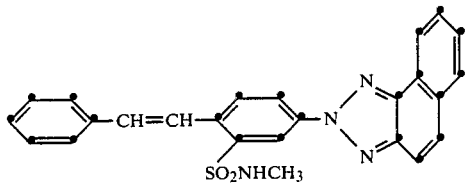

2. Triton 770 TM (available from Rohm & Haas, Philadelphia, Pa.) was used as the surfactant in place of the equivalent sodium octylphenoxypolyethoxysulfonate surface active agent illustrated in Example 2 of the reference; and 3. Sodium lauryl sulfate was used in place of the equivalent sodium alkyloxyethylsulfonate in solution B.

In the preparation of the latex, Solution A was warmed to 40° C. to dissolve the optical brightener in the monomers. After 4 hours of polymerization according to the reference teaching (i.e. conventional emulsion polymerization with conventional stirring), the resulting latex was a sticky, rubbery mass that could not be coated on a substrate. No high shear dispersion technique was used to form small monomer droplets within the aqueous medium. It was apparent that the latex polymer particles and optical brightener had agglomerated into an unusable mass. These results occurred with each attempt to practice the reference teaching.

EXAMPLE 2

Crystal- and Agglomeration-Free Element

This is a comparative example comparing an element of this invention to an element of the prior art.

Part A

A "loaded" latex was prepared according to the teaching of U.S. Pat. No. 4,203,716 (noted hereinabove).

Distilled water (10.3 kg) was added to a 40 L reaction vessel and agitated at 120 rpm while heating to 85° C. A nitrogen atmosphere was maintained throughout the preparation. Potassium persulfate initiator (100 g) was dissolved in distilled water (2.5 kg) and the resulting solution was added to the reactor vessel along with Triton 770 TM surfactant (125 g, 30% solids). In a head tank, sodium hydroxide (190 g) was added to distilled water (8.75 kg) while being maintained at 20°-25° C.

2-Acrylamido-2-methylpropanesulfonic acid monomer (500 g) was added to the head tank with good mixing and the pH of the dispersion was adjusted to 3.3 with sodium hydroxide. Also added to the head tank were potassium persulfate initiator (50 g) dissolved in distilled water (1.25 kg), Triton 770 TM surfactant (125 g, 30% solids), butyl acrylate monomer (3 kg) and tetrahydrofurfuryl methacrylate monomer (6.5 kg). An air mixer was used to emulsify the monomer mixture in the head tank.

When the temperature of the contents of the reactor vessel was stabilized at 85° C., a solution of sodium meta bisulfite initiator (30 g) in distilled water (500 g) was added to the reaction vessel. Simultaneously, addition of the monomer mixture to the reaction vessel from the head tank was begun and continued over 45 minutes. Following total addition of the monomer mixture, the emulsion polymerization was allowed to proceed for 3 hours at 85° C. After this time, the latex was cooled to 25° C. and filtered through a 1μ Fulflo TM filter (available from Fulflo Corporation located in Lebanon, Ind.). Further purification was accomplished by diafiltering the latex (diluted to 10% solids with distilled water) for 5 turnovers through a 20 K polysulfone membrane, and then concentrating it to 22.5% solids by ultrafiltration.

To a 80 L vessel were added tetrahydrofuran solvent (23.3 kg), Uvitex OB TM optical brightener (408.2 ) and Biostat PE-878 TM biocide (32.6 ml). Biostat PE-878 TM is commercially available from Eastman Kodak Company located in Rochester, N.Y. The resulting mixture was agitated with a stirrer at 90 rpm and the temperature was gradually adjusted to 55° C. An antifoam agent SAG-10 TM (28.6 g) (commercially available from Union Carbide located in Hackensack, N.J.) was added to 36.3 kg of the purified latex. When the vessel contents had reached 38°-42° C., the latex was added rapidly and vacuum was applied. About 15.1 kg of the solvent was distilled off at 75 mm Hg at 45° C. and the vacuum was then released. A sample of the resulting "loaded" latex was removed and evaluated as explained below. Once the temperature had reached 55° C., dry gelatin (1633 g) was sifted into the vessel with good mixing to provide a coating composition of the remaining "loaded" latex. The mixing was continued for 30 minutes after gel addition. The resulting hydrophilic coating composition was then filtered through a 5μ Fulflo TM filter and chill-set until use.

The sample of "loaded" latex removed prior to gel addition and a sample of the hydrophilic coating composition made with gel were evaluated for crystals and agglomerations by coating the samples on separate glass substrates and drying the coatings to form coated elements. These elements were examined with an optical microscope at 250× magnification using polarized illumination. Table I hereinbelow lists the elements evaluated to obtain the pictures of FIGS. 1-4 taken at that magnification.

TABLE I

Figure 3:
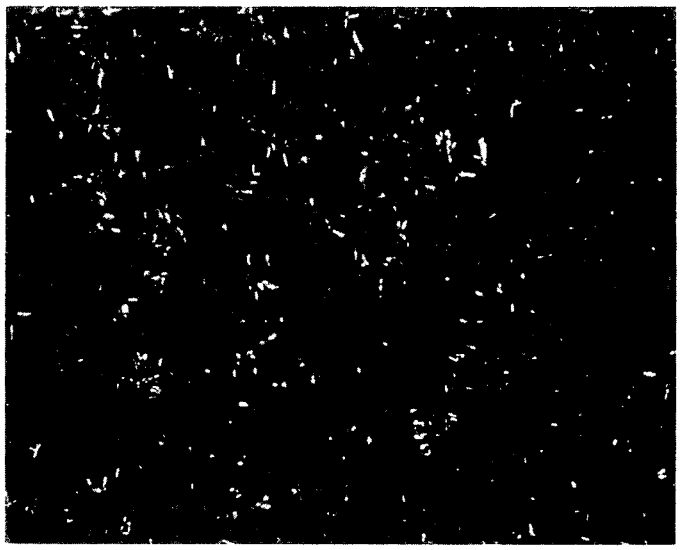

| Figure | Element | Keeping Conditions |
|---|---|---|
| 1 | "Loaded" Latex | None-tested immediately after coating and drying |
| 2 | "Loaded" Latex | Element of FIG. 1 kept 4 hours at 60° C. |
| 3 | Hydrophilic Composition | None-tested immediately after coating and drying |
| 4 | Hydrophilic Composition | Element of FIG. 3 kept 4 hours at 60° C. |

Figure 2:
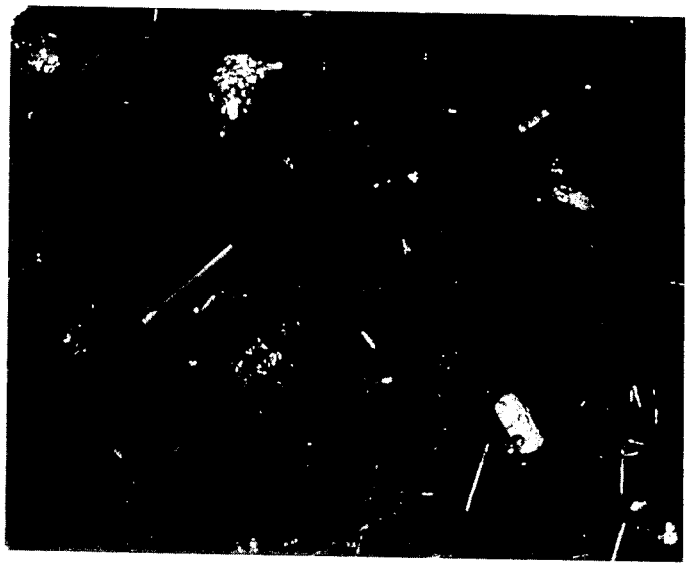
Figure 4:
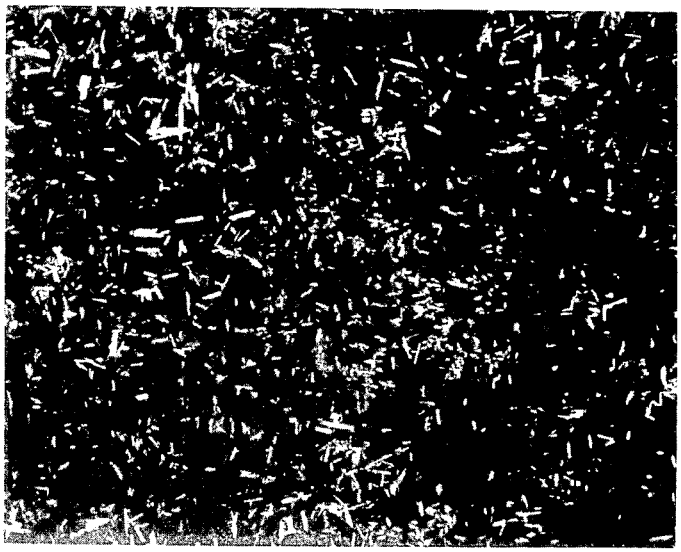

In FIGS. 1-4, crystals appear as bright needle-like spots on the dark background. As can be seen from FIG. 1, the "loaded" latex coated without binder and evaluated immediately after coating contained many very fine crystals immediately after coating, These crystals became well-formed rectangles and needles after keeping for 4 hours at 60° C. as seen in FIG. 2. These keeping conditions represent melt-hold conditions. FIGS. 3 and 4 are pictures of hydrophilic compositions containing a "loaded" latex and a binder. Large numbers of optical brightener crystals can be observed. FIG. 4 indicates that the number of crystals increases under conventional melt-hold conditions.

The samples of "loaded" latex and hydrophilic composition were also evaluated for agglomerations using electron microscopic techniques. The presence of agglomerations was observed in each sample with the number of agglomerations greater under conventional melt-hold conditions (4 hours at 60° C.).

Part B

An element of the present invention was prepared in the following manner.

A suspension of polymeric particles was prepared according to the procedure described in Example 1 (Part A) using tetrahydrofurfuryl methacrylate, n-butyl acrylate and 2-acrylamido-2-methylpropanesulfonic acid as monomers and Uvitex OB TM optical brightener as the hydrophobe.

The suspension containing polymer particles was taken from the reaction vessel after which the vessel was cleaned. The suspension was returned to the vessel and the pH was adjusted to 7 with 10% sodium hydroxide at 60° C. and 200 rpm stirring. A sample of the suspension was taken for evaluation as described below. A 10% gelatin solution in water was added to the reaction vessel and stirring was continued for another 15 minutes.

The resulting hydrophilic composition was filtered through cheesecloth and chill-set. Little or no coagulum was found in the reaction vessel.

A sample of the suspension taken prior to gelatin addition and a sample of the hydrophilic composition containing gelatin were coated and evaluated for crystals and agglomerations as described for the "loaded" latex in Part A hereinabove. Table II below lists the corresponding elements evaluated.

TABLE II

Figure 5:
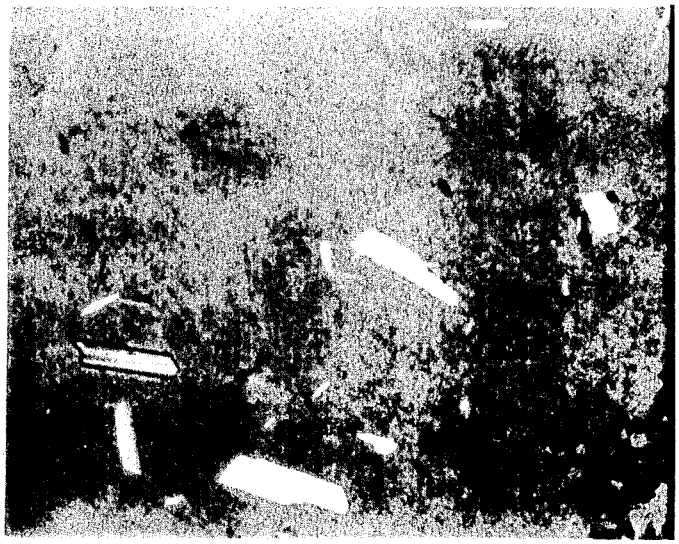
FIGS. 5–8 are photomicrographs taken at 250× magnification of suspensions of polymeric particles and of elements containing hydrophilic coating compositions comprising those particles prepared according to this invention.
Figure 7:
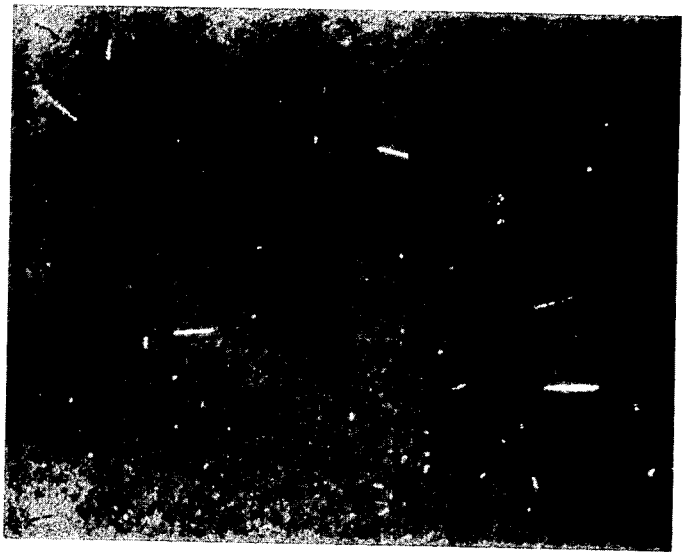

| Figure | Element | Keeping Conditions |
|---|---|---|
| 5 | Suspension containing polymer particles | None-tested immediately after coating and drying |
| 6 | Suspension containing polymer particles | Element of FIG. 5 kept 4 hours at 60° C. |
| 7 | Hydrophilic Composition | None-tested immediately after coating and drying |
| 8 | Hydrophilic Composition | Element of FIG. 7 kept 4 hours at 60° C. |

Figure 6:
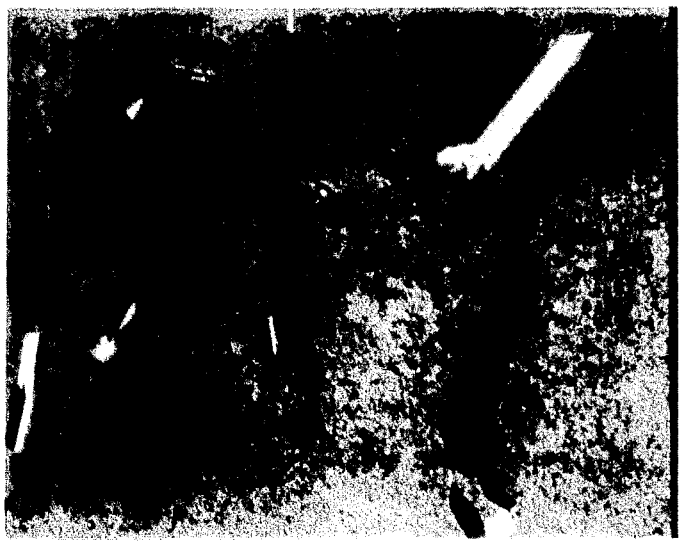
Figure 8:
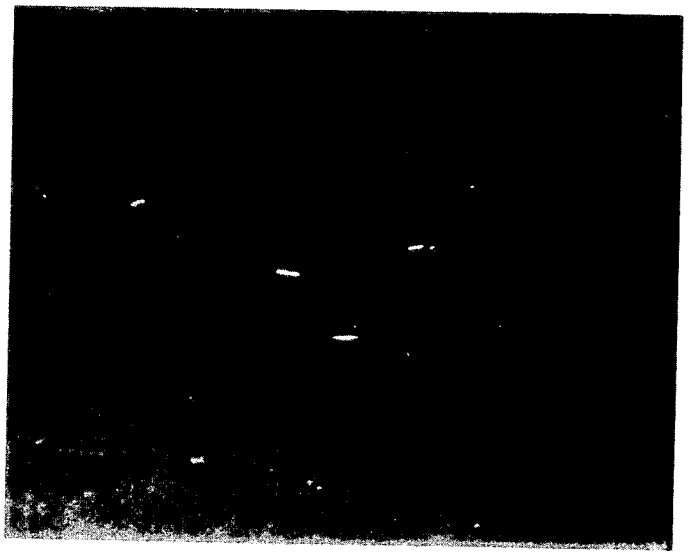

In FIGS. 5–8, as in Part A, crystals appear as bright needle-like spots in the dark background. As can be seen from the Figures, a few large crystals appear in the suspension immediately after coating (FIG.5). Further, there is little change under conventional melt-hold conditions (FIG. 6). The element containing the hydrophilic composition has only 3 crystals in a 3.5×4.5 in. (8.9×11.4 cm) coated area viewed at 250× magnification (FIGS. 7 and 8). It is quite clear that the elements shown in FIGS. 7 and 8, which are prepared according to the practice of this invention, exhibit significant improvement over the elements prepared in Part A according to the prior art (FIGS. 3 and 4).

The suspension of polymer particles and hydrophilic composition containing same were also evaluated for agglomerations using electron microscopic techniques. Substantially no agglomerations were observed in either the suspension or composition, even after keeping under the melt-hold conditions.

EXAMPLE 3

A photographic element of this invention containing an optical brightener hydrophilic layer was prepared in the following manner. This example differs from Example 1 in that the polymer of this example is a crosslinked polymer.

Methyl methacrylate (1.15 kg), styrene (1.15 kg) and ethylene dimethacrylate (46 g) monomers and Aerosol OT-100 TM (23 g) surfactant were stirred in a reactor vessel at 30° C. until the surfactant was dissolved. Uvitex OB TM (80 g) brightener and 2,2'-azobis(2-methylpropionitrile) (11.5 g) were similarly added to and dissolved in the monomer solution. Once all of the reagents were dissolved in the monomers, stirring in the vessel was increased to about 200 rpm and an aqueous solution of Aerosol A268 TM surfactant (46 g in 5.4 L distilled water) was added to the monomer solution.

The resulting dispersion was stirred for an additional 5 minutes and then pumped through a commercially-available high shear Manton-Gaulin mill at 3800 rpm using an orifice clearance of 0.004 in (0.01 cm) and a flow rate of 1.5 L/min. into another reactor vessel where stirring was set at 40 rpm and the temperature controlled at 70° C. Polymerization proceeded for 20 hours at 70° C. to give a suspension of polymeric particles of about 30% solids.

This suspension was mixed with gelatin to provide a hydrophilic composition as described in Example 1 hereinabove. The resulting composition was coated on a resin-coated support to provide an element of this invention.

EXAMPLE 4

A polymeric suspension of poly(methyl methacrylate-co-styrene-co-p-styrene sodium sulfonate-co-ehtylene dimethacrylate) (48.5:48.5:1:2 weight ratio) particles containing Uvitex OB TM optical brightener was prepared as described in Example 3. This suspension was mixed with gelatin and incorporated as a brightener layer in a color photographic paper product having the following format using conventional coating techniques and materials.

| | | | |
|---|---|---|---|
| Overcoat | gelatin | 0.5–2 g/m$^2$ | |
| Ultraviolet Light Absorbing Layer | gelatin | 0.5–2 g/m$^2$ | |
| | UV light absorber | 0.1–0.6 g/m$^2$ | |
| Cyan Dye Layer | AgClBr (15:85 mole % Cl:Br) | 0.1–0.5 g/m$^2$ | Ag |
| | gelatin | 1–2 g/m$^2$ | |
| | cyan dye-providing coupler 1[a] | 0.4–0.8 g/m$^2$ | |
| Ultraviolet Light Absorbing Layer | gelatin | 0.5–2 g/m$^2$ | |
| | UV light absorber | 0.1–0.6 g/m$^2$ | |
| Magenta Dye Layer | AgClBr (15:85 mole % Cl:Br) | 0.1–0.5 g/m$^2$ | Ag |
| | gelatin | 1–2 g/m$^2$ | |
| | magenta dye-providing coupler 2[b] | 0.4–0.8 g/m$^2$ | |
| Interlayer | gelatin | 0.5–2 g/m$^2$ | |
| Yellow Dye Layer | AgClBr (12:88 mole % Cl:Br) | 0.1–0.5 g/m$^2$ | Ag |
| | gelatin | 1–2 g/m$^2$ | |
| | yellow dye-providing coupler 3[c] | 0.8–1.5 g/m$^2$ | |
| Brightener Layer | Polymer particles | 0.5–2 g/m$^2$ | |

-continued

| | |
|---|---|
| Uvitex OB TM brightener | 0.03–0.06 g/m$^2$ |
| gelatin | 0.8–1.5 g/m$^2$ |
| Polyethylene-coated Paper Support | |

[a]Coupler 1

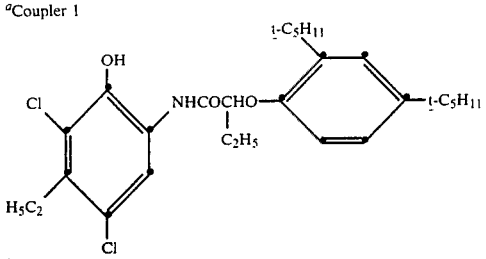

[b]Coupler 2

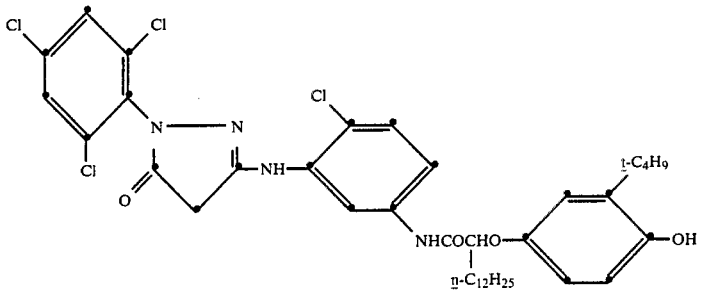

[c]Coupler 3

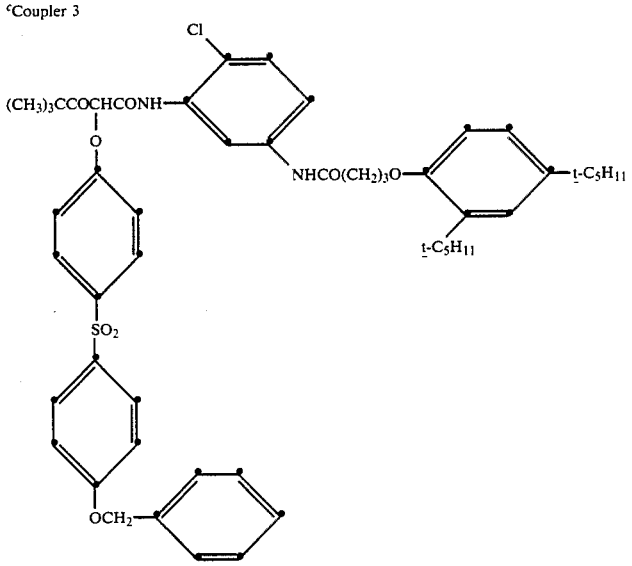

Each gelatin-containing layer was hardened with bis(vinylsulfonylmethyl) ether at 1.8% based on the gelatin coverage.

A control paper product was similarly prepared except that the brightener layer was omitted.

Without imagewise exposure, a sample of each element was fixed for 4 minutes at 38° C. with a conventional fixing composition, washed 3 minutes at 38° C. and processed with the Kodak Ektaprint TM 2 process (see "Using Kodak Ektaprint 2 Chemicals," 2nd Ed., Eastman Kodak Co. Publication Z-122, 1980). The reflection density ($D_{min}$) of each sample was then measured using a Wratten 25 filter for the red, Wratten 106 filter for the green and Wratten W48 and 2A filters for the blue. The results are presented in Table I below.

TABLE I

| | Density ($D_{min}$) | | |
|---|---|---|---|
| | Red | Green | Blue |
| Control | 0.116 | 0.127 | 0.128 |
| Example 4 | 0.115 | 0.124 | 0.114 |

It can be seen from these data that while the red and green $D_{min}$s are substantially identical for both elements, the blue $D_{min}$ is significantly decreased in the element containing the brightener layer. These results indicate the effectiveness of the brightener incorporated in the polymer particles.

EXAMPLES 5 AND 6

These examples are similar to Example 4 except that the polymer particles containing an optical brightener are incorporated in the interlayer between the magneta and yellow dye layers instead of a separate brightener layer.

Uvitex OB TM was incorporated in poly(n-butyl acrylate-co-tetrahydrofurfuryl methacrylate-co-2-acrylamido-2-methylpropanesulfonic acid, sodium salt) (30:65:5 weight ratio) particles (Example 5) and poly(-methyl methacrylate-co-ethylene dimethacrylate ) (98:2 weight ratio) particles (Example 6) according to the procedure described in Example 3.

The resulting polymer suspensions were incorporated in the interlayer and elements were prepared as described in Example 4. A control element was also prepared like the control element of Example 4.

A sample of each element was processed and the yellow $D_{min}$ level of each measured as described in Example 4. The difference in Control $D_{min}$ and example $D_{min}$ are shown in Table II below.

TABLE II

| | Change in Yellow ($D_{min}$) |
|---|---|
| Example 5 | −0.1 |
| Example 6 | −0.1 |

These data indicate the brightening effectiveness of the brightener-containing polymeric particles in the interlayers of the elements.

EXAMPLE 7

This example illustrates the incorporation of a cyan dye-forming coupler in polymer particles and the use of such particles in a photographic element.

The coupler was incorporated into poly(n-butyl methacrylate-co-methacrylic acid) particles in the following manner:

n-Butyl methacrylate (114 g), methacrylic acid (36 g), 2-[α-(2,4-di-t-pentylphenoxy)-butyramido]-4,6-dichloro-5-ethylphenol (90 g) and Aerosol OT TM surfactant (7.2 g) were placed in a 1 L vessel and heated at 50° C. under a nitrogen atmosphere until all materials were dissolved. Distilled water (600 g) was placed in a conventional blender, heated to 60° C. and the monomer solution was added thereto and mixed at high speed for 5 minutes. The resulting dispersion was added to a 2 L reaction vessel and heated to 70° C., after which $K_2S_2O_8$ (1.8 g in 10 mL of water) and $Na_2S_2O_5$ (0.72 g in 10 mL of water) were added to the vessel. After two hours of reaction, the resulting suspension was filtered to remove a small amount of coagulum and the filtrate was adjusted to pH 5.5.

The polymer particle suspension was then warmed to 50°–60° C. and a 5% solution of gelatin containing 52 g of dry gelatin was gradually added. The resulting hydrophilic composition was stirred for 30 minutes at 50° C.

This hydrophilic composition was coated in a photosensitive emulsion layer on a polyethylene-coated paper support. The coating coverages were 0.3 g/m$^2$ Ag, 2.8 g/m$^2$ gelatin and 1.24 g/m$^2$ polymer particles. The gelatin was hardened with bis(vinylsulfonylmethyl) ether at 1.75% based on gelatin weight.

The resulting element was exposed for 0.1 sec. to a 3000° K. light source through a Wratten 29 filter and a graduated neutral density tablet, and processed with the Ektaprint TM 2 process described in Example 4. Sensitometric evaluation of the element indicated that it exhibited suitable cyan dye color.

EXAMPLE 8

Comparison of Optical Brightener Wandering in Elements

This is a comparative example showing the reduced tendency of an optical brightener to wander in a multilayer photographic paper product of this invention compared to the wandering tendency of the same optical brightener in a similar paper product prepared according to the prior art, as in Part A of Example 2 hereinabove.

The elements of this example had the following general structure:

| |
|---|
| overcoat layer |
| cyan dye layer |
| UV-light absorbing layer |
| magenta dye layer |
| interlayer |
| yellow dye layer |
| optical brightener layer |
| polyethylene resin coating |
| paper support |

The specific ingredients of each layer other than the optical brightener layer are not critical to the purpose of this example, but are conventional in the photographic chemistry art.

The optical brightener layer of the element of this invention contained gelatin as the hydrophilic binder (0.8–1.5 g/m$^2$) and particles of poly(n-butyl acrylate-co-tetrahydrofurfuryl methacrylate-co-2-acrylamido-2-methylpropanesulfonic acid, sodium salt) (49:49:2 weight ratio) (0.5–2 g/m$^2$) containing Uvitex OB TM optical brightener (0.03–0.06 g/m$^2$) uniformly dispersed throughout the particles.

The optical brightener layer of the Control element contained a "loaded" latex (0.5–2 g/m$^2$) like that described in Part A of Example 2 of poly(methyl methacrylate-co-styrene-co-ethylene dimethacrylate) (35:60:5 weight ratio) dispersed in gelatin (0.8–1.5 g/m$^2$). The latex was "loaded" with about 1 weight percent of Uvitex OB TM optical brightener although not all of the brightener was in latex particles.

Figure 9:
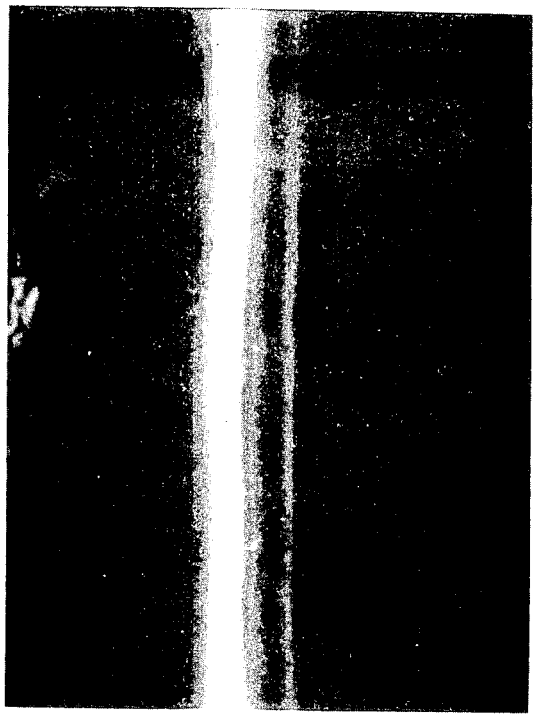
FIGS. 9 and 10 are cross-sectional UV-fluorescence micrographs taken at 1000× magnification of a prior art element and an element of this invention, respectively.
Figure 10:
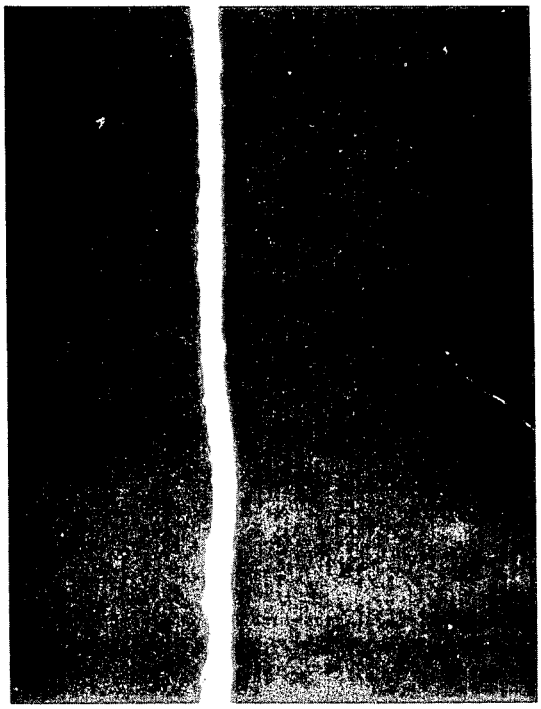

UV-fluorescence microscopy was used to study the optical brightener wandering in each element. A cross-section of each element was subjected to fluorescent light at 1000× using an ultraviolet light filter. FIG. 9 is a photograph of the cross-section of the Control element. The light areas against the dark background indicate considerable wandering of the optical brightener from the visually bright optical brightener layer. FIG. 10, however, illustrates that little wandering occurred in the element of this invention.

The invention has been described in detail with particular reference to preferred embodiments thereof, but it will be understood that variations and modifications can be effected within the spirit and scope of the invention.

I claim:

1. A radiation-sensitive element comprising a support having thereon one or more radiation-sensitive layers, and a substantially crystal- and agglomeration-free hydrophilic layer comprising a hydrophilic composition comprising a hydrophilic binder and water-insoluble polymer particles dispersed therein, said polymer particles having recurring units characterized by the structure:

$$-(A)_w(B)_x(C)_y$$

wherein -A- represents randomly recurring units derived from one or more vinyl aromatics, olefins and diolefins, vinyl esters or esters of $\alpha,\beta$-unsaturated polymerizable carboxylic acids; -B- represents randomly recurring units derived from one or more ethylenically unsaturated polymerizable monomers having one or more anionic moieties; -C- represents randomly recurring units derived from one or more ethylenically unsaturated polymerizable monomers having a crosslinkable moiety; w represents a weight percent from about 80 to 100; x represents a weight percent of from 0 to about 20; and y represents a weight percent of from about 0 to about 5, all based on total monomer weight, and wherein said polymer particles comprise less than about 5 weight percent of other randomly recurring units derived from one or more ethylenically unsaturated polymerizable monomers other than -A-, -B-, or -C-, said hydrophilic composition comprising from about 15 to about 70 weight percent, based on total dry weight of said hydrophilic composition, of said polymer particles, and said polymer particles comprising from about 0.5 to about 10 percent, based on total monomer weight, of a hydrophobe uniformly distributed throughout, said substantially crystal- and agglomeration-free hydrophilic layer having less than 5 observable crystals of said hydrophobe in a 8.9×11.4 cm area of said hydrophilic layer as observed at 250× magnification.

2. The element of claim 1 wherein said hydrophobe is an oxazole, oxadiazole, imidazole, pyrazoline, coumarin, stilbene, triazine, imidazolone, naphthotriazole, acetylene or vinylene optical brightener.

3. The element of claim 2 wherein said optical brightener is a stilbene or naphthotriazole.

4. The element of claim 1 wherein said hydrophilic layer is interposed between said support and said radiation-sensitive layer(s).

5. The element of claim 1 wherein -A- represents randomly recurring units derived from one or more vinyl aromatics or esters of $\alpha,\beta$-unsaturated polymerizable carboxylic acids; -B- represents randomly recurring units derived from one or more monomers having one or more sulfo or carboxy moieties; and -C- represents randomly recurring units derived from one or more diacrylates or dimethacrylates.

6. The element of claim 1 wherein w is from about 90 to about 99 weight percent; x is from about 0.5 to about 5 weight percent; and y is from about 0.5 to about 5 weight percent.

* * * * *